US005082821A

United States Patent [19]

Itabashi et al.

[11] Patent Number: 5,082,821

[45] Date of Patent: Jan. 21, 1992

[54] HEAT-SENSITIVE RECORDING MATERIALS

[75] Inventors: Yuichi Itabashi; Takayuki Hayashi, both of Shizuoka, Japan

[73] Assignee: Fuji Photo Film Co., Ltd., Kanagawa, Japan

[21] Appl. No.: 602,897

[22] Filed: Oct. 24, 1990

Related U.S. Application Data

[63] Continuation of Ser. No. 327,890, Mar. 23, 1989, abandoned.

[30] Foreign Application Priority Data

Mar. 23, 1988 [JP] Japan ..... 63-69054

[51] Int. Cl.[5] ..... B41M 5/18

[52] U.S. Cl. ..... 503/200; 503/226

[58] Field of Search ..... 503/200, 206; 428/195, 428/211, 304.4, 537.5, 913, 914

[56] References Cited

U.S. PATENT DOCUMENTS 4,980,337 12/1990 Kawasaki et al. ..... 503/226

FOREIGN PATENT DOCUMENTS 0283048 3/1988 European Pat. Off. .
0334607 3/1989 European Pat. Off. .
1394431 2/1965 France .
156087 12/1980 Japan ..... 503/200
225987 12/1984 Japan ..... 503/200

OTHER PUBLICATIONS

Japanese Patent Abstract 59-162091, vol. 9, No. 14, Sep. 12, 1984.
Japanese Patent Abstract 69-169894, vol. 9, No. 25, Sep. 25, 1984.

*Primary Examiner*—Pamela R. Schwartz
*Attorney, Agent, or Firm*—Sughrue, Mion, Zinn, Macpeak & Seas

[57] ABSTRACT

A heat-sensitive recording material comprising a support having provided thereon a heat-sensitive recording layer, wherein the support comprises a fine porous membrane sheet comprising a synthetic resin and/or cellulose derivative.

5 Claims, No Drawings

HEAT-SENSITIVE RECORDING MATERIALS

This is a continuation of application Ser. No. 07/327,890 filed Mar. 23, 1989 now abandoned.

FIELD OF THE INVENTION

This invention relates to a heat-sensitive recording material. More particularly, it relates to a heat-sensitive recording material having a high sensitivity, wherein high printed image densities can be obtained with a low printing energy, and a high image quality.

BACKGROUND OF THE INVENTION

Recording materials using electron donating dye precursors and electron accepting compounds are well known as pressure-sensitive recording papers, heat-sensitive recording papers, light-sensitive and pressure-sensitive recording papers, and electric heat-sensitive recording papers etc. The details of these recording materials are disclosed, for example, in British Patent 2,140,449, U.S. Pat. No. 4,480,052 and 4,436,920, JP-B-60-23922, JP-A-57-179836, JP-A-60-123556 and JP-A-60-123557 (The terms "JP-A" and "JP-B" as used herein mean "unexamined published Japanese patent application" and "examined Japanese patent publication", respectively).

These recording materials are required (1) to have an image having sufficient color density with color forming sensitivity, (2) to have a good dot reproducibility and excellent in granularity and gradation properties, (3) not to fog, (4) to have an image having sufficient fastness after color formation, (5) to form a hue suited for copying machines, (6) to have a high S/N ratio, and (7) to have a colored image sufficiently resistant to chemicals, and the like. However, none of the conventional recording materials has completely fulfilled these requirements.

Various recording systems have been investigated with a view to resolving these requirements, and remarkable achievements have been made with heat-sensitive recording materials. Heat-sensitive recording materials having a higher sensitivity, i.e., a sufficient color density obtained with a lower printing energy, are required in order to reduce the printing energy which has accompanied miniaturization of the equipment and to shorten the sending times. Further since heat-sensitive papers are used for the output of high image quality comparable to that silver salt photography, a high image quality heat-sensitive paper which has improved dot reproducibility of the printing head is also required.

To meet these demands for higher sensitivity and higher image quality, methods of increasing the heat responsibility of the heat-sensitive color forming layer materials and of improving the smoothness of the recording paper surface in order to improve the contact between the thermal head and the recording paper have been investigated. However, there are limits with these methods and really satisfactory materials have not yet been obtained.

SUMMARY OF THE INVENTION

One object of this invention is to provide heat-sensitive recording materials which have a high printing density at low printing energies, with which the dot reproducing properties of the printing head are good, and with which there are no problems such as head contamination.

As a result of extensive investigation to resolve the problems described above, it has been found in that the above object can be met by a recording material comprising a support having provided thereon a heat-sensitive color forming layer wherein the support comprises a fine porous membrane sheet comprising a synthetic resin and/or cellulose derivatives.

DETAILED DESCRIPTION OF THE INVENTION

The fine porous membrane sheet which is used in this invention can be made from any material which can be classified as a synthetic resin and/or cellulose derivative. In general, a solution of a synthetic resin and/or cellulose derivative is flow stretched as a thin layer membrane on a temporary support or substrate, and then the solvent is removed or replaced under appropriately controlled conditions to obtain the fine porous membrane sheet.

The pore diameter of the fine porous material membrane sheets of this invention is preferably from 0.05 to 1,000 μm, and more preferably from 0.1 to 200 μm.

The pore density of the fine porous membrane sheets of this invention is preferably 0.3 to 0.95, more preferably 0.6 to 0.9. The "pore density ($\epsilon$)" as used herein can be defined by the following equation:

$$\epsilon = 1 - \frac{\rho_p}{\rho_t}$$

wherein $\rho_p$ is a bulk density of the material (support) and $\rho_t$ is a vacuum density of solid substance (true density).

The thickness of the fine porous membrane sheets of this invention is preferably 3 to 3,000 μm, more preferably 20 to 300 μm.

Such fine porous membrane sheets were known in the past, and details have been described, e.g., in R. Kesting, *Synthetic Polymer Membranes,* published by McGraw-Hill (1971).

Known materials for fine porous membrane sheets include those made using cellulose esters as raw materials, as disclosed, for example, in U.S. Pat. Nos. 1,421,341, 3,133,132 and 2,944,017, JP-B-43-15698, JP-B-45-33313, JP-B-48-39586 and JP-B-48-40050, those made using aliphatic polyamides as raw materials, as disclosed, for example, in U.S. Pat. Nos. 2,783,894, 3,408,315, 4,340,479, 4,340,480 and 4,450,126, German Patent DE 3,138,525 and JP-A-58-37842, those made using polyfluorocarbons as raw materials, as disclosed, for example, in U.S. Pat. Nos. 4,196,070 and 4,340,482, JP-A-55-99934 and JP-A-58-91732, those made using polysulfones as raw materials as disclosed, for example, in JP-A-56-154051, JP-A-56-86941 and JP-A-56-12640, those made using polypropylene as the raw material disclosed, for example, in German Patent (OLS) 3,003,400, those made using nylon as the raw material disclosed, for example, in JP-B-49-8707, and others made using polyvinylidene chloride or polyvinyl alcohol as the raw material, and the effect of the invention can be obtained using any of these materials. Of these, cellulose derivatives and polysulfones are preferably used in this invention. As cellulose derivatives, cellulose ester is preferred, and cellulose acetate is more preferred.

The heat-sensitive color forming layer coating solution used in this invention are described below.

The heat-sensitive color forming layer coating solution is prepared by dispersing the electron donating dye precursor (hereinafter referred as "color former") and the electron accepting compound (hereinafter referred as "color developer") separately, together with a water soluble high molecular weight material in water, mixing the dispersions of color former and color developer so obtained together, and adding inorganic and/or organic pigments, waxes, metal soaps etc., if desired. The heat-sensitive color forming layer coating solution is generally coated onto the aforementioned porous membrane support in a coated amount of color former is from 0.2 to 2.0 g/m$^2$, preferably 0.3 to 1.0 g/m$^2$.

The surface of the fine porous membrane sheets is preferably subjected to a pre-treatment, such as a corona discharge treatment, glow discharge treatment, ultraviolet irradiation, acid etching treatment with a chrome nitrate mixture or flaming treatment with a gas flame for example, before coating with the heat-sensitive layer coating solution in order to improve wetability and to strengthen the adhesion of the heat sensitive color forming layer.

Further, an interlayer as described in, for example, in U.S. Pat. No. 4,506,669 may be provided between the surface of the fine porous membrane sheet and the heat-sensitive color forming layer in order to provide the support with a smoother surface.

The color former used in this invention include, for example, triarylmethane compounds, di-phenylmethane compounds, xanthene compounds, thiazine compounds and spiropyran based compounds.

Specific examples have been disclosed, for example, in JP-A-55-227253. To mention just a few of these, there are, for example, the triarylmethane compounds such as 3,3-bis(p-dimethylphenylaminophenyl)-6-dimethylaminophthalide, 3,3-bis(p-dimethylaminophenyl)phthalide, 3-(p-dimethylaminophenyl)-3-(1,3-dimethylindol-3-yl)phthalide and 3-(p-dimethylaminophenyl)-3-(2-methylindol-3-yl)phthalide; diphenylmethane compounds such as 4,4-bisdimethylaminobenzhydrin benzyl ether, N-halophenyl-leuco-auramine and N-2,4,5-trichlorophenyl-leuco-auramine, xanthene compounds such as rhodamine B anilinolactam, rhodamine(p-nitroanilino)-lactam, 2-dibenzylaminofluoran, 2-anilino-3-methyl-6-diethylaminofluoran, 2-anilino-3-methyl-6-dibutylaminofluoran, 2-anilino-3-methyl-6-N-ethyl-N-isoamylaminofluoran, 2-anilino-3-methyl-6-N-methyl-N-cyclohexylaminofluoran, 2-anilino-3-chloro-6-diethylaminofluoran, 2-anilino-3-methyl-6-N-ethyl-N-isobutylaminofluoran, 2-anilino-6-dibutylaminofluoran, 2-anilino-3-methyl-6-N-methyl-N-tetrahydrofurfurylaminofluoran, 2-anilino-3-methyl-6-piperidinoaminofluoran, 2-(o-chloroanilino)-6-diethylaminofluoran, and 2-(3,4-dichloroanilino)-6-diethylaminofluoran, thiazine compounds such as benzoyl leuco methylene blue and p-nitrobenzyl leuco methylene blue, and spiro compounds such as 3-methyl-spiro-dinaphthopyran, 3-ethyl-spiro-naphthopyran, 3,3-dichloro-spiro-dinaphthopyran, 3-benzyl-spiro-dinaphthopyran, 3-methylnaphtho(3-methoxybenzo)spiropyran, and 3-propyl-spiro-dibenzopyran.

As the color developer used in this invention phenolic compounds, and salicylic acid derivatives and polyvalent metal salts thereof, are preferred.

Examples of phenolic compounds include, for example, 2,2'-bis(4-hydroxyphenyl)propane, 4-tert-butylphenol, 4-phenylphenol, 4-hydroxydiphenoxide, 1,1'-bis(3-chloro-4-hydroxyphenyl)cyclohexane, 1,1'-bis(4-hydroxyphenyl)cyclohexane, 1,1'-bis(3-chloro-4-hydroxy-phenyl)-2-ethylbutane, 4,4'-sec-isooctylidenediphenol, 4,4'-sec-butylidenediphenol, 4-tert-octylphenol, 4-p-methylphenylphenol, 4,4'-methylcyclohexylidenephenol, 4,4'-isopentylidenephenol and benzyl p-hydroxybenzoate.

Examples of salicylic acid derivatives include, for example, 4-pentadecylsalicylic acid, 3,5-bis(α-methylbenzyl)salicylic acid, 3,5-di(tert-octyl)salicylic acid, 5-octadecylsalicyclic acid, 5-α-(p-α-methylbenzylphenyl)ethylsalicylic acid, 3-α-methylbenzyl-5-tert-octylsalicyclic acid, 5-tetradecylsalicyclic acid, 4-hexyloxysalicylic acid, 4-cyclohexyloxysalicyclic acid, 4-decyloxysalicyclic acid, 4-dodecyloxysalicyclic acid, 4-pentadecyloxysalicylic acid, 4-octadecyloxysalicyclic acid, and the zinc, aluminum, calcium, copper and lead salts thereof. These color developers are preferably used in an amount of from 50 to 800% by weight, and more preferably in an amount of from 100 to 500% by weight, with respect to the color former. Color formation is unsatisfactory if the amount used is less than 50% by weight, while no further effect can be anticipated on adding more than 800% by weight.

The heat-sensitive recording materials of this invention may contain heat-fusible substances in the heat-sensitive color forming layer in order to improve their heat responsibility. Examples of the preferred heat-fusible substances include benzyl p-benzyloxybenzoate, β-naphthyl benzyl ether, stearic acid amide, stearylurea, p-benzylbiphenyl, bis(2-methylphenoxy)ethane, bis(2-methoxyphenoxy)ethane, β-naphthol-(p-methylbenzyl)ether, α-naphthyl benzyl ether, 1,4-butanediol-p-methylphenyl ether, 1,4-butanediol p-isopropylphenyl ether, 1,4-butanediol p-tert-octyl phenyl ether, 1-phenoxy-2-(4-ethylphenoxy)ethane, 1-phenoxy-2-(4-chlorophenoxy)ethane, 1,4-butanediol phenyl ether, and diethyleneglycol bis(4-methoxyphenyl)ether. The aforementioned heat-fusible substances can be used individually or in combinations thereof.

An amount of the heat-fusible substances is preferably from 10 to 300% by weight, and most preferably from 20 to 200%, by weight with respect to the color developer.

The color former, the color developer and the heat-fusible substance are dispersed in a water soluble binder in this invention.

As the binder, a compound having a solubility of at least 5% by weight in water at 25° C. is preferred.

Specific examples of such compounds include polyvinyl alcohol (including modified polyvinyl alcohols such as carboxy modified polyvinyl alcohol, itaconic acid modified polyvinyl alcohol, maleic acid modified polyvinyl alcohol and silica modified polyvinyl alcohol), methylcellulose, carboxymethylcellulose, starches (including modified starches), gelatin, gum arabic, casein, styrene-maleic anhydride copolymer hydrolyzates, polyacrylamide, and saponified forms of vinyl acetate-polyacrylic acid copolymers.

These binders are used not only for dispersion but also to increase the strength of the coated film. Binders such as latexes of synthetic high molecular weight materials such as styrene-butadiene copolymer, styrene-vinyl acetate copolymer, acrylonitrile-butadiene copolymer and polyvinylidene chloride can be used conjointly for this purpose. Furthermore, if desired, appropriate crosslinking agents of binder may be added according to the type of binder.

As pigments, calcium carbonate, barium sulfate, lithopone, agalmatolite, kaolin, silica, amorphous silica etc. can be used.

As metal soaps, metal salts of higher fatty acids, such as zinc stearate, calcium stearate, aluminum stearate, etc., can be used.

As a waxes, paraffin wax, microcrystalline wax, carnauba wax, methylolstearoamide, polyethylene wax, polystyrene wax, and fatty acid amide waxes etc. can be used individually or in combinations thereof.

In addition, if necessary, surfactants, anti-static agents, ultraviolet absorbing agent, antioxidants, defoaming agents, electric conductive agents, fluorescent dyes and coloring dyes and the like may be added.

Furthermore, in order to prevent fading of the printed parts of the image and to increase the fastness of the image which has been formed, anti-fading agents are preferably added to the heat-sensitive color forming layer.

Phenols, especially hindered phenols, are effective as anti-fading agents, and examples thereof include 1,1,3-tris(2-methyl-4-hydroxy-tert-butylphenyl)-butane, 1,1,3-tris(2-ethyl-4-hydroxy-5-tert-butylphenyl)butane, 1,1,3-tris(3,5-di-tert-butyl-4-hydroxyphenyl)butane, 1,1,3-tris(2-methyl-4-hydroxy-5-tert-butylphenyl)propane, 2,2'-methylene-bis(6-tert-butyl-4-methylphenol), 2,2'-methylene-bis(6-tert-butyl-4-ethylphenol), 4,4'-butylidene-bis(6-tert-butyl-3-methylphenol), and 4,4'-thio-bis(3-methyl-6-tert-butylphenol). The amount of these phenols used is preferably from 1 to 200% by weight, and more preferably from 5 to 50% by weight, with respect to the color developer.

After coating the aforementioned heat-sensitive color forming layer coating solution, the coated heat-sensitive recording materials are dried and subjected to a calendering treatment, and then supplied for use.

A protective layer, if necessary, may be provided on top of the heat-sensitive recording layer. Any of the materials known as protective layers for heat-sensitive recording materials can be used for the protective layer in this invention.

Moreover, if necessary, a backing layer as described, for example, in U.S. Pat. No. 4,591,887 may be provided on the opposite side of the support to the heat-sensitive recording layer of the heat-sensitive recording material. Any of the materials known as backing materials for heat-sensitive recording materials can be used for the backing layer in this invention.

The present invention will now be illustrated in greater detail by way of the following examples and comparative examples, but the present invention is not to be limited thereto. In these examples, all parts, ratios and percentages are by weight unless otherwise indicated.

EXAMPLE 1

A uniform mixture of composition (1) indicated below was prepared and flow stretched onto a flat stainless steel plate and dried for 2 hours at room temperature and then dried for 30 minutes at 80° C to form a fine porous membrane of thickness about 120 μm. This membrane was then peeled off the flat plate to provide the fine porous membrane sheet support (1) (pore diameter: 0.45 μm).

| Composition (1) | |
|---|---|
| Cellulose acetate (acetyl value: 5.50) | 6 parts |

-continued

| Composition (1) | |
|---|---|
| Glycerol | 1 part |
| Methylene chloride | 54 parts |
| Methanol | 35 parts |
| Water | 5 parts |

Next, 20 g of each of 2-anilino-3-methyl-6-N-ethyl-N-isoamylaminofluoran, benzyl p-hydroxybenzoate, and β-naphthyl benzyl ether were dispersed separately in 100 g of an aqueous 5% solution of polyvinyl alcohol ("Kuraray PVA 105") for an overnight by means of a ball mill to provide each dispersion having an average particle size of less than 1.5 μm or less.

Furthermore, 80 g of calcium carbonate was dispersed in 160 g of a 0.5% solution of sodium hexametaphosphoric acid to provide a pigment dispersion.

These liquid dispersions were mixed together to provide a heat-sensitive color forming layer coating solution having the composition indicated below.

| Composition of Heat Sensitive Color Forming Layer Coating Solution | |
|---|---|
| 2-Anilino-3-methyl-6-N-ethyl-N-isoamylaminofluoran dispersion | 5 parts |
| 2,2'-Bis(4-hydroxyphenyl)propane dispersion | 10 parts |
| β-Naphthyl benzyl ether dispersion | 5 parts |
| Calcium carbonate dispersion | 22 parts |
| 20% Zinc stearate dispersion | 3 parts |

This heat-sensitive color forming layer coating solution was coated onto the aforementioned support (1) using a coating bar so as to provide a coated layer having a dry amount of 5 g/m$^2$, and this was dried for 1 minute at 50° C. to provide a heat-sensitive recording sheet.

EXAMPLE 2

A uniform solution mixture of composition (2) indicated below was prepared and flow stretched over a flat stainless steel plate. A cover was placed on top for 2 seconds, after which the plate was left to stand at room temperature in the air for 5 seconds and then it was immersed in a coaggulation tank which contained water at 20° C. Then the membrane was peeled off and the solvent was removed and the membrane was dried to provide the fine porous membrane sheet support (2) (pore diameter: 0.3 μm) having a thickness of 120 μm.

| Composition (2) | |
|---|---|
| Polysulfone (P-3500, made by ICI Co.) | 15 parts |
| N-methyl-2-pyrrolidone | 70 parts |
| Polyvinylpyrrolidone | 15 parts |

The heat-sensitive color forming layer coating solution obtained in Example 1 was coated onto the aforementioned support (2) using a coating bar to provide a coated layer having a dry amount of 5 g/m$^2$, and this was dried for 1 minute at 50° C. to provide a heat-sensitive recording sheet.

EXAMPLE 3

A uniform mixture of composition (3) indicated below was coated using a coating bar onto Support 1 obtained in Example 1 so as to provide a dry coated amount of 5 g/m$^2$, and dried to provide support (3) (pore diameter: 0.5 μm).

| Composition (3) | |
|---|---|
| 40% Calcium carbonate dispersion | 30 parts |
| 48% SBR latex (SN-307, made by the Sumitomo Norgatac Co.) | 5 parts |
| Water | 20 parts |

The heat-sensitive color forming layer coating solution obtained in Example 1 was coated using a coating bar onto the aforementioned Support 3 to provide a coated layer of dry amount of 5 g/m$^2$, and dried for 1 minute at 50° C. to provide a heat-sensitive recording sheet.

COMPARATIVE EXAMPLE 1

A heat-sensitive recording sheet was obtained in the same manner as in Example 1 except that wood free paper was used for the support instead of support (1).

COMPARATIVE EXAMPLE 2

A heat-sensitive recording sheet was obtained in the same manner as in Example 3 except that wood free paper was used instead of support (1).

COMPARATIVE EXAMPLE 3

A heat-sensitive recording sheet was obtained in the same manner as in Example 1 except that synthetic paper ("YUPO", made by Oji Yuka) was used for the support instead of support (1).

The heat-sensitive recording sheets obtained in the various manners described above were subjected to a surface calendering treatment and fitted into a thermal printing test machine which had a thermal head (KLT-216-8MPD1, made by Kyocera Corp.), and printing was carried out under conditions of a head voltage of 24V, a pulse cycle of 10 ms, with pulse widths of 0.8, 1.0 and 1.2 ms, and the print density was measured using an RD-918 Macbeth reflection densitometer.

Furthermore, the amount of material attached to the head (head contamination) after printing was measured at the same time.

The results obtained are shown in the table below.

TABLE

| Example No. | Color Density: Print Pulse Width 0.80 (ms) | Color Density: Print Pulse Width 1.00 (ms) | Color Density: Print Pulse Width 1.20 (ms) | Dot Reproducing Properties | Head Contamination |
|---|---|---|---|---|---|
| Example 1 | 0.92 | 1.38 | 1.45 | ○ | ◎ |
| Example 2 | 0.90 | 1.37 | 1.45 | ○ | ○ |
| Example 3 | 0.88 | 1.35 | 1.45 | ○ | ○ |
| Comparative Example 1 | 0.55 | 0.90 | 1.25 | X | Δ |
| Comparative Example 2 | 0.60 | 1.00 | 1.30 | Δ | ○ |
| Comparative Example 3 | 0.70 | 1.22 | 1.40 | ○ | X |

◎: very good, ○: Good, Δ: Practical, X: Impractical

It can be seen from the table that the heat-sensitive recording sheets of this invention have good color densities even at low energies, that they had good dot reproducibility, and that they have a good performance in that there was no head contamination.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having provided thereon a heat-sensitive recording layer, wherein said support consists essentially of a fine porous membrane sheet comprising polyswfones and/or cellulose, esters.

2. The heat-sensitive recording material as claimed in claim 1, wherein said cellulose esters are a cellulose acetate.

3. The heat-sensitive recording material as claimed in claim 1, wherein the pore diameter of said fine porous membrane sheet is from 0.05 to 1,000 μm.

4. The heat-sensitive recording material as claimed in claim 3, wherein the pore diameter of said fine porous membrane sheet is from 0.1 to 200 μm.

5. The heat-sensitive recording material as claimed in claim 1, wherein a coating solution which forms said heat-sensitive color forming layer is coated in an amount of from 0.2 to 2.0 g/m$^2$ of a color former in said heat-sensitive recording layer.

* * * * *